US005240432A

United States Patent [19]

Daoud

[11] Patent Number: 5,240,432

[45] Date of Patent: Aug. 31, 1993

[54] INSULATION DISPLACEMENT CONNECTORS

[75] Inventor: Bassel H. Daoud, Parsippany, N.J.

[73] Assignee: AT&T Bell Laboratories, Murray Hill, N.J.

[21] Appl. No.: 935,954

[22] Filed: Aug. 26, 1992

[51] Int. Cl.[5] ..... H01R 13/00

[52] U.S. Cl. ..... 439/417

[58] Field of Search ..... 439/389–425

[56] References Cited

U.S. PATENT DOCUMENTS

| | | | |
|---|---|---|---|
| 2,647,245 | 7/1953 | Gilbert | 439/417 |
| 4,723,915 | 2/1988 | Gentry | 439/417 |
| 4,820,191 | 4/1989 | Lacroix | 439/417 |
| 4,830,625 | 5/1989 | Vignoli | 439/417 |
| 4,913,659 | 4/1990 | Doyle . | |
| 4,978,314 | 12/1990 | Maejima | 439/417 |
| 5,049,088 | 9/1991 | Rishworth et al. | 439/417 |
| 5,064,383 | 11/1991 | Locati et al. | 439/417 |
| 5,120,246 | 6/1992 | Knox | 439/417 |

*Primary Examiner*—Joseph H. McGlynn

*Attorney, Agent, or Firm*—Ruloff F. Kip, Jr.

[57] ABSTRACT

There are disclosed improvements for an electrical connector comprising a terminal for an insulative housing, electroconductive means disposed at least partly in such housing and having a portion connectable to a wire, a cap initially seatable in an up position on said housing, and adapted to be forcibly pushed down from said up position to a down position on said housing, and means permitting insertion of said lead into the space enclosed by such housing and cap and for effecting connection in said space of said inserted lead with said electroconductive means. The improvements are providing (1) in the same connector multiple terminals of the sort just described, (2) an arrangement which latches the cap from being detached from the housing in response to application to the terminal solely of lifting force on the cap, but which permits selective releasing of the cap in response to a force exerted by hand in the direction other than that of such lifting force, (3) strain relief for isolating the mentioned connection from pulling force on the lead.

4 Claims, 5 Drawing Sheets

INSULATION DISPLACEMENT CONNECTORS

FIELD OF THE INVENTION

This invention relates generally to connectors for making an electrical connection between each of one or more insulated wire leads and each of one or more other insulated or uninsulated wires. More particularly, this invention relates to connectors of such kind which do not require the use of any tool to make such connection, and which are insulative displacement connectors in the sense that they comprise an insulative base and insulative housing and are operable to make such connection by relative displacement of these two insulative elements.

BACKGROUND OF THE INVENTION

U.S. Pat. No. 4,913,659 issued Apr. 3, 1990, in the name of Clarence E. Doyle for "Push Cap Terminals and Terminal Boards with Same" (the Doyle patent) discloses an electrical connector comprising a terminal for an insulated wire lead comprising an upstanding insulative housing, electroconductive means disposed at least partly in such housing and having a portion connectable to a wire, a cap initially seatable in an up position on said housing, and adapted to be forcibly pushed down from said up position to a down position on said housing, and means permitting insertion of said lead into the space enclosed by such housing and cap and for effecting connection in said space of said inserted lead with said electroconductive means.

The terminal disclosed in such patent (the "Doyle patent") has been very satisfactory in the application therefor which it is disclosed in that patent, and which is as one of a plurality of insulated wire lead terminals (there being one such terminal per lead) mounted on a terminal board ordinarily connected up and otherwise serviced by experienced telephone company technicians. That disclosed terminal would, however, have the disadvantages, if provided for its connecting up, by technically unskilled persons, that the cap of the terminal detaches too readily from its housing, and that the connection in the connector of the wire lead inserted therein may be too easily opened up by pulling force exerted on the lead and causing the lead to slide out from the terminal strip by which it was previously gripped.

SUMMARY OF THE INVENTION

One or both of the disadvantages just mentioned are overcome according to the invention by providing one or both of the improvement features of (a) latching means operable when the cap is in the down position to unyieldably restrain it from being upwardly moved from said position in response to application to the terminal solely of lifting force exerted in the upward direction on the cap, and (b) strain relief means provided by said terminal and adapted, by frictionally contacting under force a portion of such lead distributed over a length thereof to isolate such connection from pulling force exerted on the lead. A connection according to the invention is not, however, necessarily limited just to a connector providing one or both of such improvement features but, rather, may be any connector defined by any of the claims hereof.

BRIEF DESCRIPTION OF DRAWINGS

For a better understanding of the invention, reference is made to an exemplary embodiment thereof and to the accompanying drawings wherein.

Figure 1:
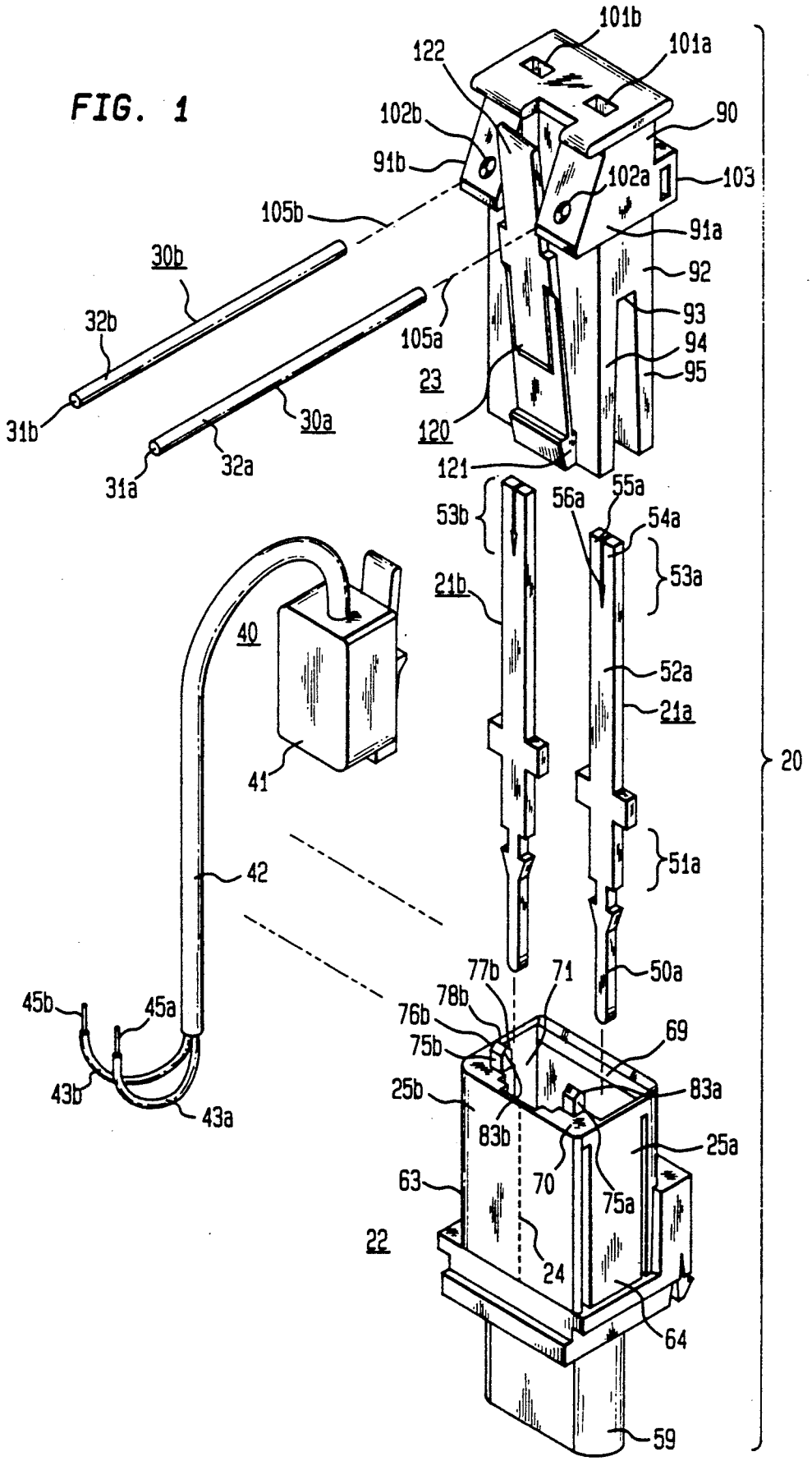
FIG. 1 is an exploded perspective view of an exemplary embodiment of connector according to the invention and of exemplary electrical conductor means adapted to be interconnected by such connector.

In the description which follows, elements which are counterparts of each other are identified by the same reference numeral but are distinguished by different alphabetical suffixes for these numerals, and it is to be understood that, unless the context otherwise indicates, a description herein of any such element is to be taken as equally applicable to each counterpart thereof.

DETAILED DESCRIPTION OF EMBODIMENT

Referring now to FIG. 1, the reference numeral 20 designates an electrical connector embodying the invention. Connector 20 comprises the components of a pair of electroconductive means 21*a*, 21*b* in the form of metallic, vertically extending terminal strips, a molded plastic insulative base or housing 22 for the strips 21, and a cap 23 for those strips. Connectors according to the invention may comprise a plurality of individual terminals each adapted to connect one wire to another wire. The connector is such a multiterminal connector which, as indicated by the dashed dividing line 24 on housing 22, is divided into duplicate left-and right-hand terminals 25*a* and 25*b* disposed side by side in the lateral dimension and containing, respectively, the terminal strips 21*a* and 21*b*.

Shown in FIG. 1 in association with connector 20 are the free ends of a pair of insulated wire leads 30*a*, 30*b* comprising metallic cores 31*a*, 31*b* and insulated jackets 32*a*, 32*b* around these cores. Typically, the leads 30 are tip and ring leads for a telephone set (not shown) disposed in, say, an apartment building at a location away from their shown free ends which may be, say, in the cellar of the building.

Also shown in FIG. 1 is a stub cord 40 comprising a conventional modular telephone plug 41 adapted to be inserted into a mating modular jack to connect the mentioned telephone set to a telephone network, a plastic ribbon 42 fastened to and extending away from plug 40, and a pair of electrical wires 43*a*, 43*b* embedded in ribbon 42 and extending from connections with plug 41 through ribbon 42 to bare ends 45*a*, 45*b* of such wires extending out from the free end of ribbon 42.

Considering now in more detail the components of connector 20, the terminal strip 21*a* is made of phosphor bronze or some other resiliently deformable electroconductive material, and the strip comprises a lower downwardly projecting stem 50*a*, a shank portion 51*a* above such stem and a support column 52*a* extending from such shank portion to an upper section 53*a*. Upper section 53*a* is a bifurcated section comprising a pair of tangs 54*a*, 55*a* separated by a contact gap 56*a* in the lateral dimension and resiliently deflectable away from each other in that dimension. The tangs 54*a*, 55*a* bear thereon respective cutting edges (not shown) adjacent to the gap 56*a*.

Terminal 21*b* is a duplicate of terminal 21*a*. These terminals are similar to the terminal strip disclosed in the aforementioned Doyle patent, incorporated herein by reference and made a part hereof, which provides more details on the characteristics of the terminal strips 21 described herein.

Figure 2:
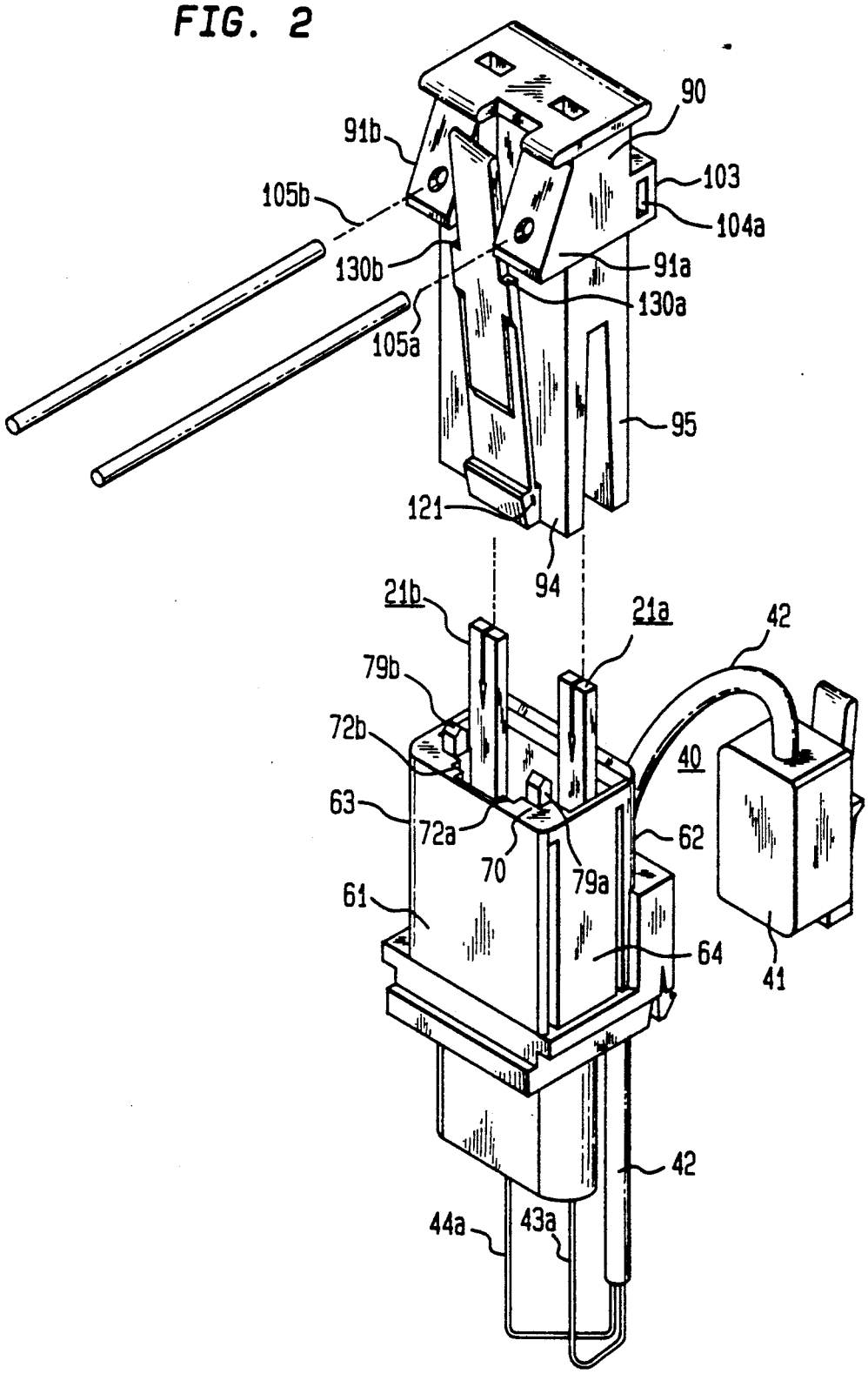
FIG. 2 is an exploded perspective view of the FIG. 1 connector and conductor after assemblage with the base of the connector of the connector's terminal strips and of a stub telephone cord terminating in a modular plug.
Figure 3:
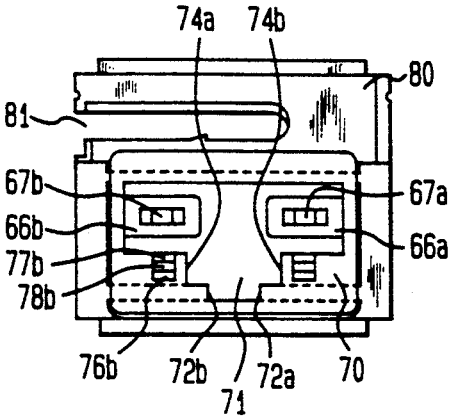
FIG. 3 is a plan view of the base or housing of the FIG. 1 connector without the terminal strips being mounted therein.
Figure 4:
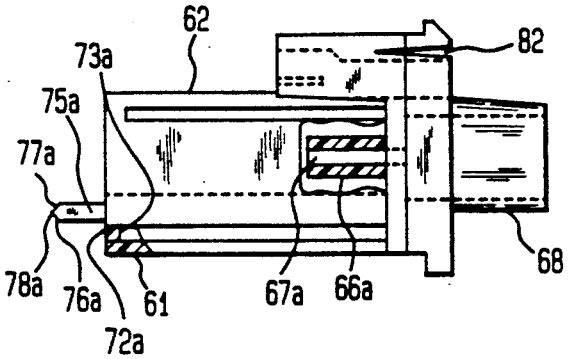
FIG. 4 is a right side elevation of the FIG. 3 housing as partly broken away to show interior portions thereof in cross section.
Figure 5:
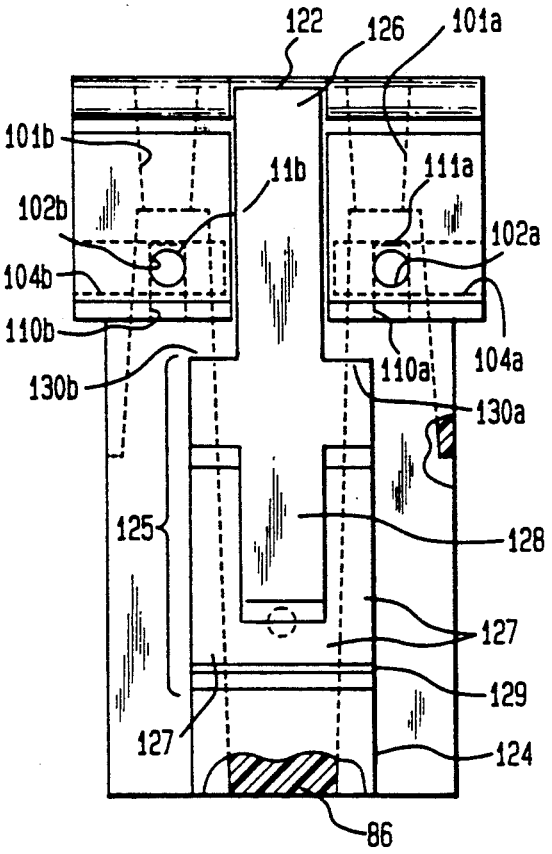
FIG. 5 is a front elevation of the cap of the FIG. 1 connector, the cap being partly broken away to show interior portions thereof in cross section.
Figure 9:
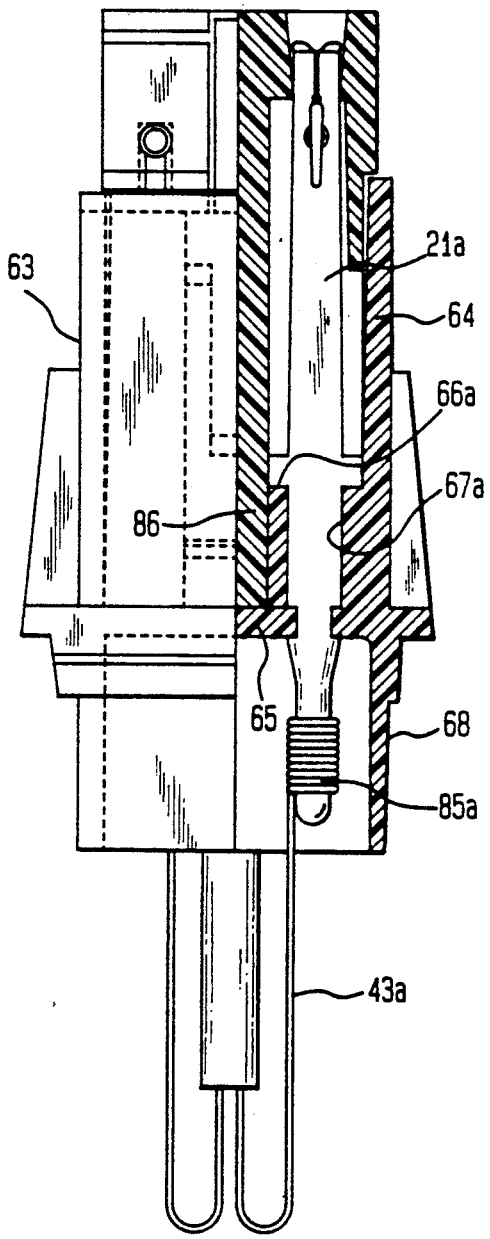
FIG. 9 is a split view with the left half of the drawing being a front elevation of the FIG. 8 assemblage, and the right half of the drawing being a front elevation in cross section of that assemblage.

Coming to the base or housing 22, that component has therein a central chamber 60 (FIG. 7) peripherally enclosed by (FIG. 2) vertical front and back longitudinally-spaced walls 61, 62 and by vertical laterally spaced left- and right-hand side walls 63 and 64. At its lower end, compartment 60 is closed (FIG. 9) by a bottom 65. Upstanding from bottom 65 are a pair of support pedestals 66*a*, 66*b* (FIG. 3). Pedestal 66*a* has formed therein a vertical slot 67*a* passing downward through the pedestal and through the compartment bottom 65. Pedestal 66 has a similar slot 67*b* therein.

In the course of assembling connector 20, the shank portions of the terminal strips 21*a*, 21*b* are seated with a tight fit in, respectively, the slots 67*a*, 67*b* in the pedestals 66*a*, 66*b* so that the stems 50 of those terminals project downward beyond the underside of compartment bottom 65, and so that the upper sections 53*a*, 53*b* of the terminal strips are positioned upwards (FIG. 2) of the chamber 60 in the housing. With the terminal strips 21 so held positionally fixed in housing 20, the stems 50 of these strips are peripherally enclosed by a skirt 59 extending on housing 22 downward beyond its chamber bottom 65.

The chamber 60 is partly closed at its top by a shelf 70 (FIG. 1) extending laterally across the housing 22 at its front. Longitudinally behind the shelf the chamber has a top opening 69 bounded at its rear by a ledge 68 (FIG. 7) projecting inwards from the top of back wall 62 of the housing. Extending into shelf 70 from its back side are two centrally located, rectangular, relatively wider and narrow notches (not numbered) of which the wider one extends into the shelf for a lesser distance than does the narrow notch. These two notches form in the top of the housing a guide passage 71 having laterally opposite margins of stepped configuration. The portions 72*a*, 72*b* of the shelf 70 which are on opposite sides of the laterally narrowest part of the guide passage 71 (and are also adjacent to the front housing wall) are shelf portions providing downward facing stop shoulders 73*a*, 73*b*. The significance of those shoulders will be later discussed.

Disposed on shelf 70 are a pair of probes 75*a*, 75*b* located on portions 74*a*, 74*b* of the shelf adjacent to its back side and on laterally opposite sides of the laterally widest part of the guide passage 71. Those probes are of square horizontal cross section and project upward from those shelf portions. The probes 75*a*, 75*b* at their top have slanting front and back faces 76 and 77 which meet at laterally extending edges 78 to form dihedral angles defined by those faces. The top triangular tips 79*a*, 79*b* of the probes 75 formed by the faces 76, 77 are convexities of which the outward surfaces have respective inflections 83*a*, 83*b* in the upward vertical direction relative to a horizontal surface passing through such tips.

The housing 22 at its back has a molded plastic portion integral with the rest of the housing and providing a clip 80 therefor. The clip 80 has formed therein a deep horizontal notch 81 extending into the body of the clip from its left side (FIG. 3) and adapted to receive and retain therein (FIG. 7) the ribbon 42 of the stub cord 40. Moreover, the clip 80 also has formed therein a smaller vertical notch 82 for receiving therein a projecting rib (not shown) of a device which is adapted to receive and mount therein the connector 20. That device may be, say, a building entrance protector device in the cellar of the mentioned apartment building.

In the course of assembling the electrical connector 20, the stub cord 40 is fastened to the housing 22 by providing wire wound couplings 85*a*, 85*b* (FIGS. 9 and 8) of the bare wire ends 45*a*, 45*b* of the wires 43 of the stub cord to the downwardly projecting stems 50 of the terminal strips 21 contained in the housing. After the stub cord has thus been fastened by the wire wound couplings 85 to the housing 22, the ribbon 42 of the stub cord is forced into the notch 81 in the clip portion 80 of the housing to be frictionally retained in that notch.

Figure 8:
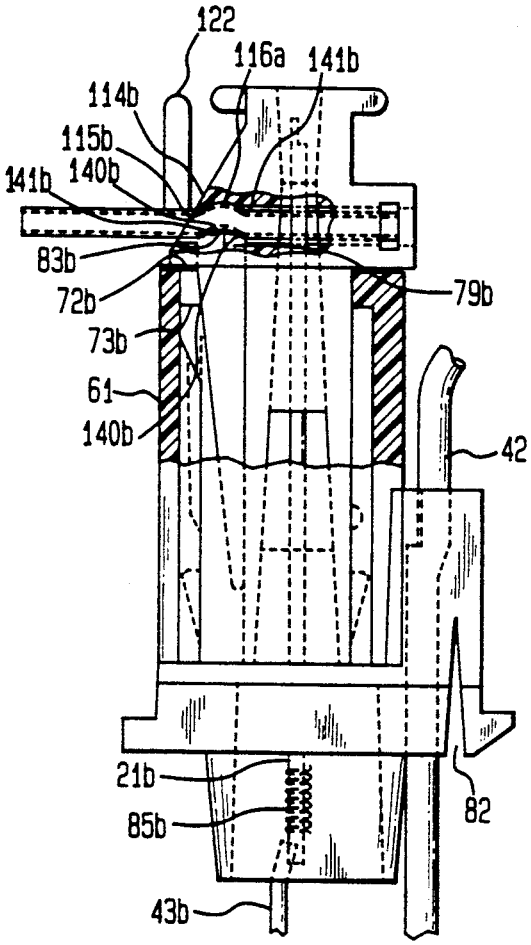
FIG. 8 is a right side elevation of the FIG. 1 assemblage when the cap has been manually forced to its down position with the housing.

Turning now to the cap component of the connector 20, the cap 23 at its top has a head 90 which is mostly solid plastic but has therein various passages soon described. At its front, the head has a pair of forwardly projecting noses 91*a*, 91*b*. Integrally joined to the underside of head 90 is a downwardly extending web 92 having a bottom 93 and dividing on longitudinally opposite sides of such bottom into front and back downwardly extending legs 94 and 95 spaced longitudinally far enough apart that they are adapted to straddle the pedestals 66 in housing 22 when (as later more described) the cap is forced down into the housing 22 (FIG. 8). Below bottom 93, the legs 94 and 95 are longitudinally joined by a central crossbraces 86 (FIGS. 6 and 9) so that cap 23 is of "H" shape in its horizontal cross section below web bottom 23. The leg 95 of the cap carries on its back side (FIG. 6) a rearwardly projecting horizontally extending detent ridge 96 and a rearwardly projecting horizontally extending rounded detent rib spaced on the leg a short distance above ridge 96 leg. Ridge 96 provides on its top a slanting detent shoulder 98 and, on its outer side, a wedging face 99.

With regard to the various passages in cap 23, the web 92 has formed therein a pair of vertical channels 101*a*, 101*b* extending from the web bottom 93 upward through the web and then through the head 90 to terminate in openings therefor at the top of the head. Such passages 101 register with and are adapted to receive therein the terminal strips 21 projecting upward (FIG. 2) from the housing.

Other passages in the cap are a pair of horizontal circular bores 102*a*, 102*b* extending from the front of hoses 91*a*, 91*b* rearwardly through those noses and head 90 to intersect with, respectively, the channels 101*a*, 101*b* and to then extend rearwardly beyond them into a projecting overhang 103 of the cap. Within that overhang, the bores 102*a*, 102*b* have blind ends for which, however, communication to the outside of the cap is provided by slit windows 104*a*, 104*b*. The bores 102*a*, 102*b* define paths 105*a*, 105*b* (FIGS. 1 and 2) for insertion of the leads 30*a*, 30*b*, into the cap and then to the channels 101*a*, 101*b* and post them into the overhang 103.

Figure 6:
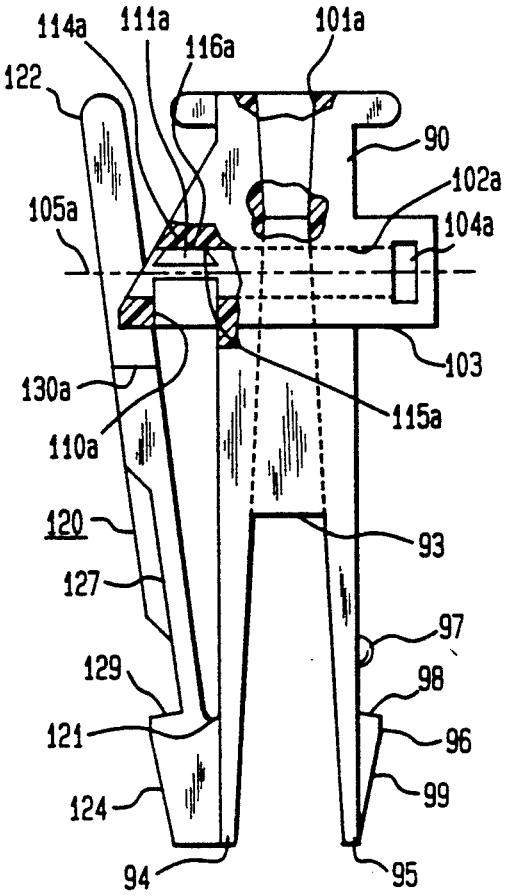
FIG. 6 is a right side elevation of the FIG. 5 cap as partly broken away to show interior portions thereof in a cross section.

Also formed as passages in the cap 23 are two apertures 110*a*, 110*b* having a square horizontal cross section slightly greater in size than the probes 75 on housing 22 and adapted to receive those probes. The apertures 110*a*, 110*b* extend in cap 23 upward from the bottoms of noses 91 to intersect with, respectively, the bores 102*a*, 102*b* and to then extend slightly upwards beyond them to terminate in top ends 111*a*, 111*b* of such apertures. As shown in FIG. 6 for the top end 111*a*, the portions 114*a*, 114*b* of connector 20 into which the top ends of those apertures penetrate are portions which have grooves 115*a*, 115*b* formed therein by such top ends. By virtue of those portions 114 having the configurations just described, the wall surfaces of such grooved portions have respective inflections 116*a*, 116*b* in the upward vertical direction relative to the surfaces of such portions bounding bores 102 to either longitudinal side of the grooves 115, and the portions 114 providing such inflections are portions having concavities therein.

The cap 23 includes as an integral part thereof a resiliently deformable cantilever beam 120 having a lower fixed end 121 integrally coupled with the front cap leg 94 on the front side of that leg (FIG. 6). From that fixed end, the beam 120 extends upwardly and forwardly to a free end 122 adapted to serve as a key button. In so extending upward, the beam passes through a slot provided laterally between the cap noses 91 to accommodate the beam.

Beam 120 above its fixed end comprises a lower section 125 of full lateral width and an upper section 126 of reduced lateral width relative to section 125. That width reduction of the upper section produces on laterally opposite sides of the lower section 125 at its top a pair of upwardly facing stop shoulders 130*a*, 130*b*. As will later be apparent, the lower section 125 comprises part of a cap latching means while the upper section 126 constitutes a cap releasing means. To increase the resilient pliancy of the lower section, it has "cut-away" portions 127 which are disposed in that section around portions of a middle ridge 128 of the same longitudinal thickness as upper section 126, and which portions 127 are of reduced longitudinal thickness relative to elements 128 and 126. At its lower end, the lower section 125 has on its outside a slanting detent shoulder 129 and a wedging face 124 below that shoulder.

USE OF THE EMBODIMENT

To put the connector 20 into ready condition for use, the cap 23 is assembled with housing 22 (with the latter already including terminal strips 21, and being fastened to cord 40) so that the cap is seated in the up position on the housing. Such assembly of the cap and housing is effected as follows. With the cap being initially spaced above the housing as shown in FIG. 2, the downward end of the cap is lowered into the top opening 69 of the housing to cause the wedging faces 99 and 124 on the cap to first engage with, respectively, the ledge 68 and the shelf portions 72 of the housing at the back and front, respectively, of that opening and to then move down past these engaged housing elements. Such downward movement is permitted by the wedging action which is created by the engagement with and movement of cap faces 99 and 124 relative to housing elements 68 and 72, and which action resiliently bends the beam 120 backward enough to enable the downward end of the cap to longitudinally fit into the housing opening 69. Once the mentioned wedging faces on the cap have moved past the housing elements engaged thereby, the ledge 68 on the housing becomes positioned between the ridge and rib elements 96 and 97 on the cap, and the detent shoulder 129 on the cap beam 120 becomes positioned below the shelf portions 72*b* on the housing. The cap 23 is thus detained in its up positioned seated on the housing 22, the upper ends of the terminal strips 21 being at that time received in the channels 101 in the cap. The cap, however, is only yieldably detained in that, because of the slant of the detaining shoulders 98 and 129, the cap by moderate lifting force thereon can be pulled up and away from the housing, and in that moderate downward force on the cap will cause the detent rib 97 to move down past ledge 68 and thus free the cap for further downward movement.

With the connector being so in ready condition, the wire leads 30 are guided along the shown paths 105 therefor to insert those leads into the bores 102 in the cap, and past the intersection of those bores with the channels 101 and then in such bores into the overhang portion 103 of the cap. The insertion of the leads is then stopped by the coming into contact of the free ends of such leads with the blind ends of the bores 102 in the overhang 103.

As a next step, the cap 23 is forcibly pushed by hand into housing 22 to have the following effects.

First, such driving down of the cap produces, relatively speaking, an upward movement in the cap channels 101 of the terminal strips 21 mounted by the housing. That upward movement initially positions the inserted wired leads 30 (now longitudinally transversing those channels) into the contact gaps 56 laterally disposed between the tongs 54 and 55 of such strips. Further upward relative movement of the strips causes a relative downward movement of the leads 30 in such gaps to bring the leads 30 into engagement with the cutting edges (not shown) on the tangs and to then move the leads further down into the gaps 56. Results are that the insulating jackets 32 of the leads are severed by such edges, and that, at the end of the cap's downward movement, the metallic cores 31 of the leads are in pressure contact with the tangs 54, 55 of the terminal strips 21 (FIG. 9) to make an electrical connection with the terminal strips and to be electrically connected through such strips with the wires 43 of cord 40 and with its modular plug 41. Further details are disclosed in the Doyle patent on the making of such electrical connection between either of leads 30 and the electroconductive means constituting the corresponding terminal 21.

Second, the downward driving of the cap into the housing produces a relative movement of the probes 75 on the housing upward into the apertures 110 in the cap until such movement is stopped either by the legs 94, 95 of the cap contacting the housing bottom 65 or by the head 90 of the cap contacting the housing's top. As shown by FIG. 8, the leads 30 inserted into the bores 102 in the cap are slightly smaller in diametral size than the bores, and the grooved portions 114 of the cap bordering those bores and the convex tips 79 of the probes constitute upper and lower lead contacting means, respectively which are disposed in vertically registering relation on opposite sides of each of the paths 105 for the leads. Further, the respective surfaces of the grooved portions 114 and the convex probe tips 79 constitute matching inflections 116 and 83 in the same upward vertical direction from the horizontal lie of the bores 102.

As further shown by FIG. 8, at the end of the relative upward movement of the probes 75 into the cap, the leads 30 are each contacted on opposite sides by the mentioned upper and lower lead contacting means, and the convex tips 79 of the probes press against, and force into the grooves 115, the portions 140 adjacent thereto of the leads 30 so as to produce in these leads inflections 141 in the upward vertical direction relative to the lead's horizontal lie elsewhere in the bores. Such inflections in the leads match the surface inflections 116 and 83 provided by the grooved portions 114 and the convex probe tips 79. To put it another way, the closure towards each other of the grooved portions 114 and the convex prove tips 79 produce inflections in the previously straight paths for the leads, which inflections substantially correspond in size, shape and direction to the surface inflections of those portions and tips.

The probe tips 79 and the connector portions 114 opposite them across bores 102 together constitute shown relief means in that they are adapted, by their closure towards each other and a resultant mutual contacting of the portions of the leads contained between them, to partly or wholly insulate the connections of the leads 30 with terminal strips 21 from pulling forces exerted outside connector 20 on those leads. Such strain relief may be realized in connector 20 in one or both of two different ways.

As a first way, when inflections are produced as described in leads 30 and in the paths 105, those inflections provide such strain relief even though, in the absence of pulling force on the leads neither the mentioned portions 114 nor the probe tips 79 contact under force the inflected lead portions 140. That is so because the effect of producing the inflections 141 in the leads 30 will be to cause a pulling force on such a lead to produce a pressing of the lead against portions of one or both of the elements 79 and 114 to thereby generate a reactive friction force which opposes the pulling force.

A second way to provide such strain relief is to design connector 20 so that an incremental amount of the downward displacement of the cap, produced at the end of its downward movement, is communicated by the inserted leads 30 to the probes 75 to resiliently depress the shelf portions 74 on which those probes are mounted, and so that, after all relative movement between the cap and housing has ceased, at least a fraction remains of that downward resilient deflection of the shelf portions. In that case, the resilient stress still existing in those shelf portions will urge the probes 75 upward to cause the elements 79 and 114 to frictionally grip between them the lengthwise distributed adjacent portions 140 of the leads under the upward vertical force exerted by the probes so as to produce in the leads 30, when needed, a friction force directed to oppose the pulling force on the leads. The same effect can be produced by the resilient compression of the insulation leads 30 which can be caused by the hard gripping of the leads between the elements 79 and 114 after termination of the down movement of the cap. Such second way of providing strain relief, can be used in conjunction with also providing such relief by the inflections 141 in the leads 30, but it can also be used even though, say, the surfaces of the elements 79 and 114 which contact the lead portions 140 are flat. An advantage of providing strain relief as described in one or both of such first and second ways is that it is produced automatically in response to downward pushing of the cap and is delayed until that time so as not to interfere with the insertion of the leads 30 into the bores 105. While if solely such second way is utilized to provide such strain relief, that downward pushing need not necessarily produce alterations in the configurations of paths 105 in the firm of inflections therein, such downward pushing will nontheless produce alterations in such path configurations in the form of constriction in such paths.

Figure 7:
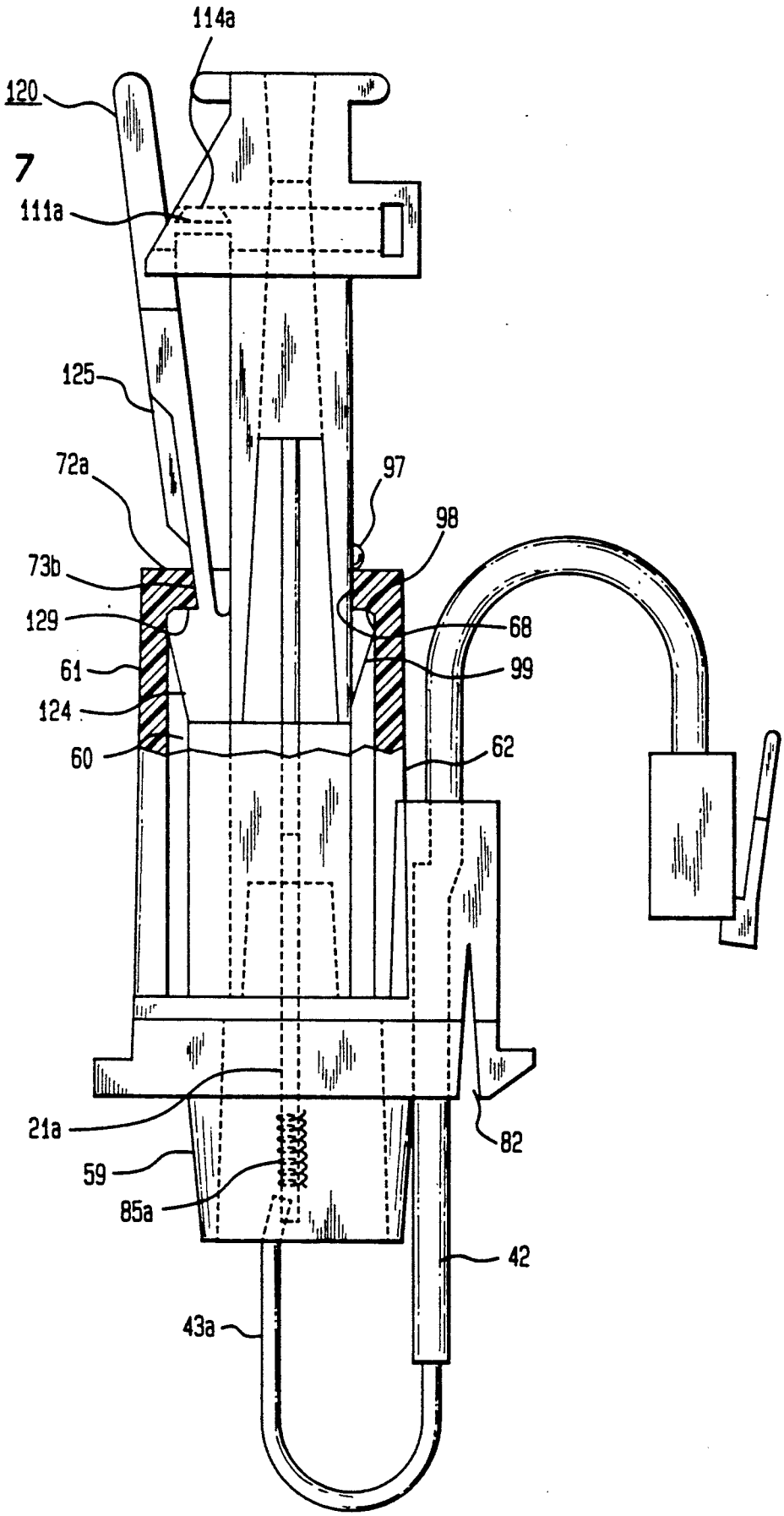
FIG. 7 is a right side elevation of the connector as shown in FIG. 2 with the cap being seated in up position on the housing and the wire leads shown in FIG. 1 being inserted in to the cap.

As another effect of the push down of the cap, as the cap 23 is driven downward into the chamber 60 in housing 22, the lower section 125 of the cantilever beam 120 on the cap slides down past the shelf portions 72 of the housing in contact with such portion to be resiliently bent into a bow shape by such contact and sliding to thereby incrementally shorten the chordal length between the fixed end 121 of the beam and the upward facing stop shoulders 130 on the beam. Those stop shoulders are so positioned in the length of the beam that, when the downward pushing of the cap into the housing is arrested, those stop shoulders will be lower by a clearance than the adjacent downward facing stop shoulders 73 provided by the undersides of the shelf portions 72. Accordingly, the resiliently deformed lower section of the beam will spring back toward its original undeformed position so as, by a snap-fitting action, to position the lower upward-facing shoulders 130 on the beam 120 of the cap beneath the upper downward-facing shoulders 73 on the housing 22. The result is that, upon the application to the connector 20 of force which is solely lifting force exerted on the cap, the cap cannot be detached from the housing because, although such lifting force urges cap 23 as, a whole and its beam shoulders 130 upward, that upward urging is equally and oppositely opposed by a downward force 7hich is exerted by the housing shoulders 73 on the cap carried shoulders 130, and which downward restraining force progressively becomes greater as the upward urging force becomes greater. To put it another way, the greater such upward lifting force, the more firmly the upward and downward facing shoulders become engaged. That downward restraining force stands in contrast to the detaining force which holds the cap 23 in its up position when seated on housing 22 as shown in FIG. 7, but which detaining force becomes progressively less and ultimately yields as the upward lifting force on the cap progressively becomes greater.

The described shoulders 73 and 130 and associated parts of the connector 20 thus provide for each of the terminals **25*a* 25*b* in the connector a latch means operable when the cap 22 is in its down position on housing 22 to unyieldably restrain it (short of breakage of parts) form being detached from the housing in response to application to the connector or terminal of force which is solely lifting force exerted in the upward direction on the cap. That latch means provides the advantage that the cap cannot be casually detached from the housing so as to cause exposure of the electrical connections within the connector. Another advantage is that such latch means is automatically actuated in response to the downward pushing of the cap to provide its latching effect, so that it is not left to chance. While the engagement between the shoulders which produces that latching effect occurs only at the front part of the connector, the shoulders cannot be disengaged by angular tilting of the cap relative to the housing inasmuch as the part of the cap which is received into housing 22** fits too tightly therein to permit an amount of tilting which would nullify the latching effect.

While the cap may be latched permanently as described to the housing, there may, however, be instances when it would be desirable to remove cap 23 from housing 22. Such removal may be accomplished by the use of the cap releasing means provided by the upper section 126 of the beam 120 in the cap. To effect such removal, rightward horizontal force (FIG. 8) is exerted by hand on the key button provided by the free end 122 of section 126 of beam 120 to resiliently bend the beam to bring it to a position at which the shoulders 130 thereon become disengaged from the shoulders 73 on the housing. Then as long as the beam is held by hand in that position, the cap 23 may readily be lifted up to separate it from the housing 22.

The described latching of the cap 23 to the housing 22 by positioning the cap shoulders 130 beneath the housing shoulders 73 is entirely satisfactory even though some clearance exists beneath the upper and lower ones of those shoulders after the cap has been driven to its down position and then released. If desired, however, any play in the vertical direction of the relative positioning of the cap and housing can be ended by providing for resilient deflection downward of the housing shelf portions 74 as earlier described, and, after the cap has been pushed as far as possible down into the housing, by utilizing that deflection of those shelf portions 74 to act through probes 75 and leads 30 to produce in the positioning of the cap an incremental upward rebound which eliminates all clearance between the shoulders 130 and 73 and brings them into pressure contact maintained by the remaining resilient stress in the deflected shelf portions 74 and/or by residual resilient compression in the insulation of the leads 30.

The above described embodiment being exemplary only, it is to be understood that additions thereto, omissions therefrom and modifications thereof can be made without departing from the spirit of the invention. For example without restriction, while the engagement and disengagement of the upward facing and downward facing shoulders on, respectively the cap and housing (so as to latch and unlatch the cap) have been described earlier herein as produced by movements of the beam 120 carried by cap 23, the same actions may be produced by the agency of an equivalent device carried by housing 22. Accordingly, the invention is not be be considered as limited save as is consonant with the scope of the following claims.

I claim:

1. An electrical connector comprising a terminal for an insulated wire lead comprising: an upstanding insulative housing, an electroconductive terminal strip fixedly seated in said housing and having an upper bifurcated portion comprising a pair of upwardly projecting cutting tangs laterally separated by a contact gap, said terminal strip also having a lower portion connectable to a wire other than said lead, an insulative cap initially seatable in an up position on said housing and adapted to be forcibly pushed down vertically from said up position to a down position in said housing, said cap comprising a solid head having formed therein an upwardly extending channel in which said tangs and contact gap are received, and first and longitudinal coaxially aligned bores disposed, respectively, on first and second longitudinally opposite sides of said channel and intersecting with said channel, said bores defining a longitudinal path which is for inserting said lead into said cap, and which extends longitudinally from outside said cap into said first bore and through both it and said contact gap into said second bore, said cap having first and second guide portions extending adjacent said channel around said first and second bores, respectively, and enclosing said path on both its upper side and its lower side to thereby guide said lead during its insertion to remain in said cap, and said cap when so pushed down producing an engagement and electrical connection of the inserted lead with said tangs, said connector further comprising strain relief means provided by said terminal and adapted by contacting a portion of said lead disposed longitudinally outward of said connection to isolate the connection of said lead with said tangs from pulling force exerted in the longitudinal direction on said lead outside of sid cap, said strain relief means comprising upper and lower lead contacting means provided by, respectively, said cap and housing on vertically /pposite sides of said path for said lead longitudinally outwards of said first guide portion of said cap which is adjacent said channel, said two lead contacting means being responsive to said forcible pushing down of said cap to undergo closure towards each other and respectively contact vertically opposite sides of said portion of said lead.

2. An electrical connector according to claim 1 in which said upper and lower said tow lead-contacting means have respective confronting surfaces which have formed therein respective inflections in the same vertical direction and registering with each other in the lengthwise horizontal direction along said path, said inflections of said confronting surfaces being adapted upon said closure towards each other of said two lead-contacting means to produce a corresponding inflection in said wire lead.

3. An electrical connector according to claim 2 in which said respective inflections of said confronting surfaces of said two lead-contacting means comprise a concavity and a matching convexity formed in one and the other of such surfaces.

4. An electrical connector according to claim 3 in which said concavity of said upper lead contacting means is provided by an indentation in the upper side of the interior bounding wall of said first bore, said cap has formed therein an aperture extending from the bottom of said cap upwards in said cap to an intersection of said aperture with the lower side of said first bore vertically opposite said concavity, and in which said convexity of said lower lead contacting means is provided by the convex tip of a probe mounted by said housing and relatively movable upward through said aperture towards said concavity when said cap is vertically pushed down in said housing.

* * * * *